US007762927B1

(12) United States Patent
Gordon

(10) Patent No.: US 7,762,927 B1
(45) Date of Patent: Jul. 27, 2010

(54) GAME APPARATUS

(76) Inventor: Donald W. Gordon, 1626 Crandall Dr., Springville, UT (US) 84663

( * ) Notice: Subject to any disclaimer, the term of this patent is extended or adjusted under 35 U.S.C. 154(b) by 1170 days.

(21) Appl. No.: 10/758,525

(22) Filed: Jan. 14, 2004

Related U.S. Application Data

(60) Provisional application No. 60/440,198, filed on Jan. 14, 2003.

(51) Int. Cl.
*A63B 21/00* (2006.01)

(52) U.S. Cl. ..... 482/27; 482/35

(58) Field of Classification Search ..... 473/466, 473/153, 481, 479; 52/169, 2; 482/26–29; 441/40; 446/20
See application file for complete search history.

(56) References Cited

U.S. PATENT DOCUMENTS 3,201,125 A * 8/1965 Vensel ..... 273/401
3,339,925 A * 9/1967 Nissen ..... 473/469
4,433,838 A 2/1984 Gordon
4,483,531 A * 11/1984 Laseman et al. ..... 482/27
4,569,515 A 2/1986 Gordon
5,226,864 A * 7/1993 Showers ..... 482/35
5,833,557 A 11/1998 Cole
6,135,922 A * 10/2000 Nissen ..... 482/27
6,280,367 B1 * 8/2001 Arsenault ..... 482/140
7,037,220 B1 * 5/2006 Gordon ..... 473/466
2005/0079954 A1 * 4/2005 Wang et al. ..... 482/27

* cited by examiner

*Primary Examiner*—Jerome Donnelly
(74) *Attorney, Agent, or Firm*—Thorpe North & Western LLP

(57) ABSTRACT

A game apparatus including at least one rebound surface and flexible material dividing the rebound surface into at least two play areas includes a rebound surface mounting frame and a flexible material mounting frame coupled to hold the frames in substantially fixed relationship but allow movement of one frame in relation to the other for stress relief between the frames. At least one cross member supports the flexible material between play areas and reinforces the flexible material mounting frame. The individual play areas are formed by separate preassembled flexible material units that are mounted in the flexible material mounting frame and then secured together to for the individual play areas. The flexible material mounting frame includes walk bars and also supports basket assemblies used in game play.

28 Claims, 13 Drawing Sheets

GAME APPARATUS

RELATED APPLICATION

Figure 1:
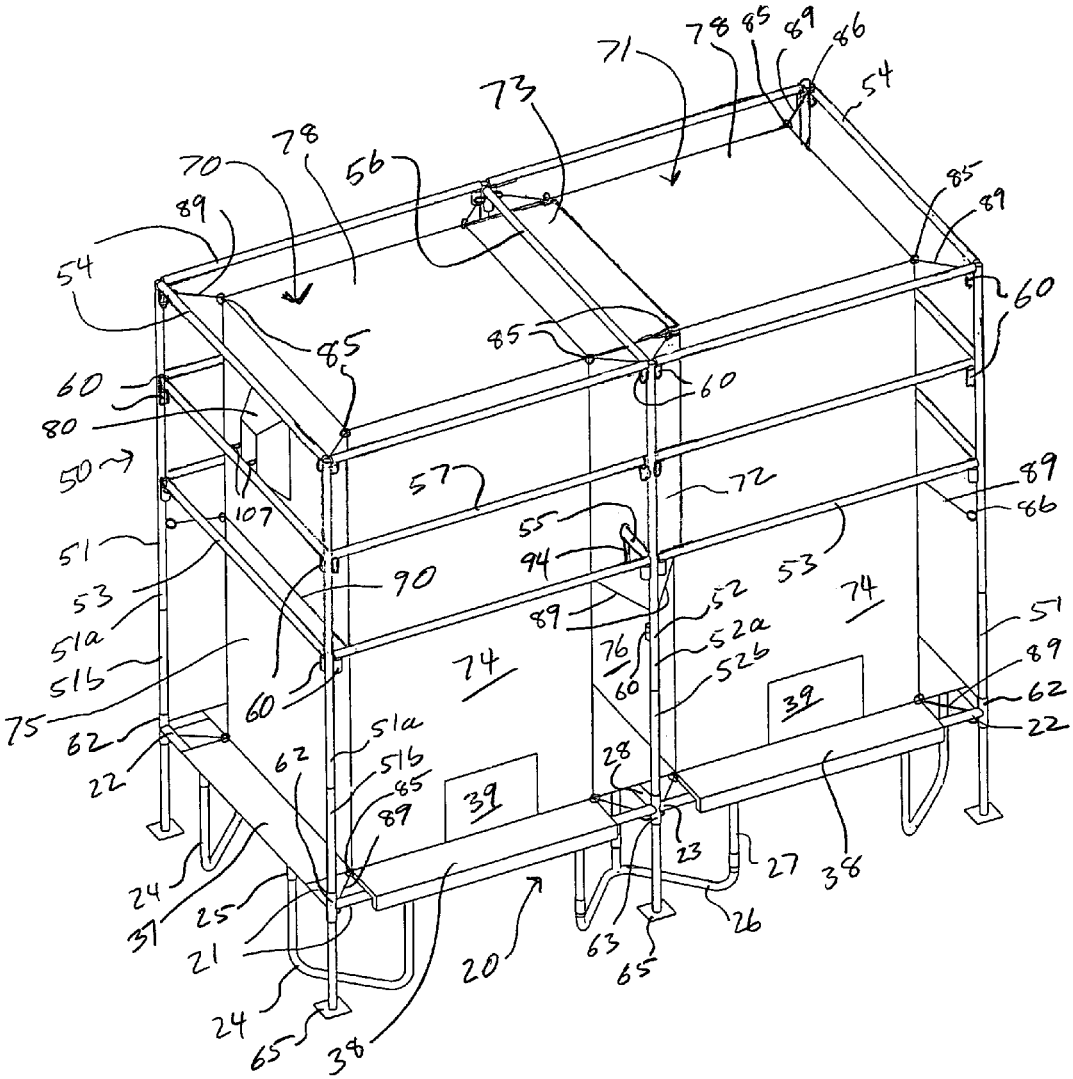

This application claims the benefit of provisional Application Ser. No. 60/440,198, filed Jan. 14, 2003.

BACKGROUND OF THE INVENTION

1. Field

The invention is in the field of game apparatus including a trampoline and structure above the trampoline for playing games while jumping on the trampoline.

2. State of the Art

In the early eighties I invented a game, with several variations, which utilized one or more trampolines and structure above the trampoline surface or surfaces. These game apparatus are described in U.S. Pat. Nos. 4,433,838 and 4,569,515, and are available commercially under the trademarks AEROBALL and HIBALL from Maze, Inc., Springville, Utah. The game apparatus includes one or more trampolines with netting around the rebound surface of the trampoline to ensure that the players jumping on the trampoline do not fall off the rebound surface and which divides the play area into individual cells with a cell for each player. The netting dividing the cells prevents the players from jumping into or hitting one another. The structure above the rebound surface provides nets and goals for players to hit or throw a ball over or into and netting to keep the ball or other play object in the playing area.

The play apparatus as shown in cited U.S. Pat. Nos. 4,433,838 and 4,569,515 generally works well but I have now made several improvements to the apparatus.

SUMMARY OF THE INVENTION

According to the invention, the rebound surface mounting frame and the flexible material mounting frame are constructed as separate frames but coupled in a manner to hold the frames in substantially fixed relationship to one another and to allow movement between the frames to relieve stress between the frames. My prior apparatus used a unitary frame. The apparatus of the invention includes preassembled flexible material units that are secured together and to a flexible material mounting frame to form the individual play areas above the rebound surfaces. My prior apparatus had a single preassembled flexible material assembly that included all play areas and was heavy, unwieldy, and difficult to install. The apparatus of the invention includes cross frame members extending across the frame between individual play areas and forming the lower edge of openings between individual play areas. This allows the individual play areas to be separated with connecting material straddling the cross members and attaching to the walls of the individual play areas to close the space between individual play areas and strengthens the frame to prevent bowing of frame members. The invention includes walk members in the flexible material mounting frame to allow a person assembling the apparatus to walk on such members and reach the top of the frame for frame assembly and attachment of the flexible material units to the frame. The connection of the goals or baskets is improved and provision is made for return of playing objects thrown into a vacant play area from the vacant play area to the player in an adjacent play area. Further, improvements in spring covers and bars to aid entry and exit to the play areas are provided.

THE DRAWINGS

Figure 2:
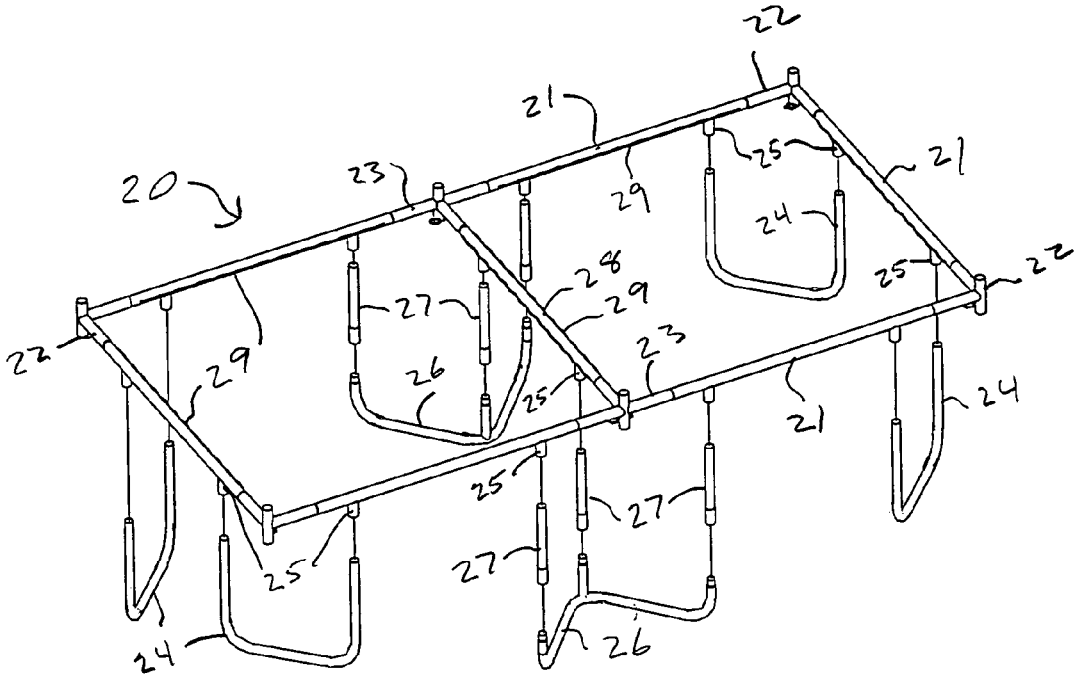
Figure 3:
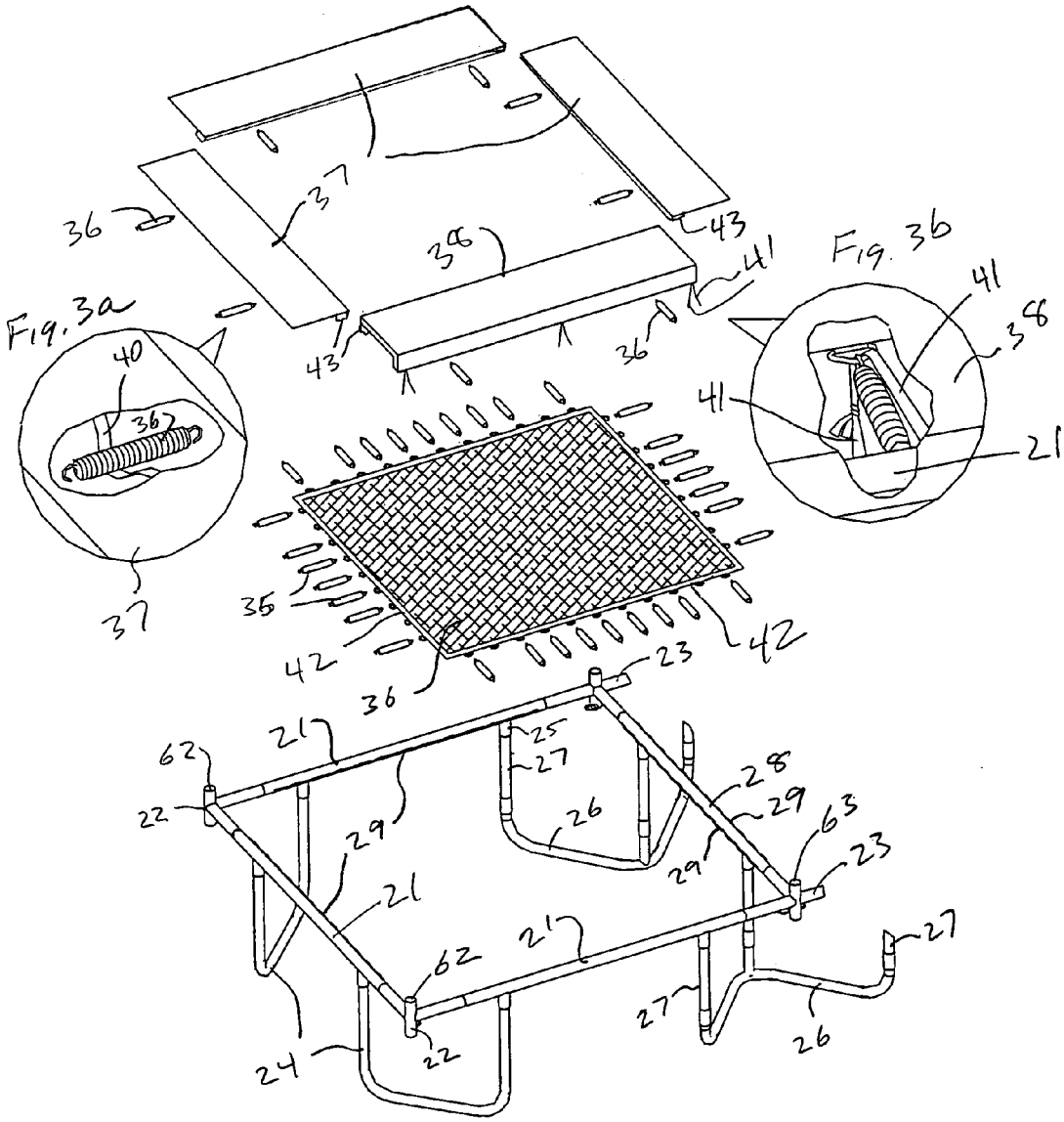
Figure 4:
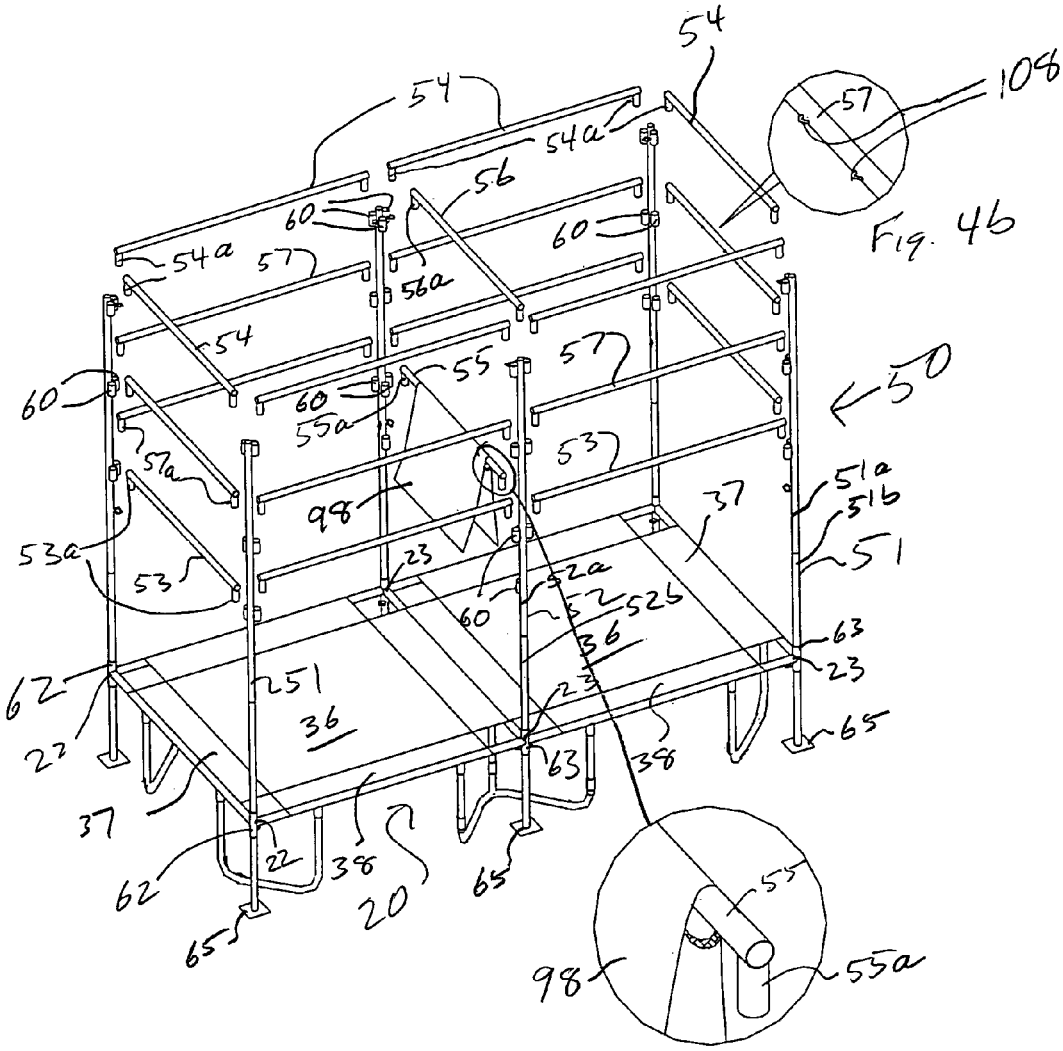
Figure 5:
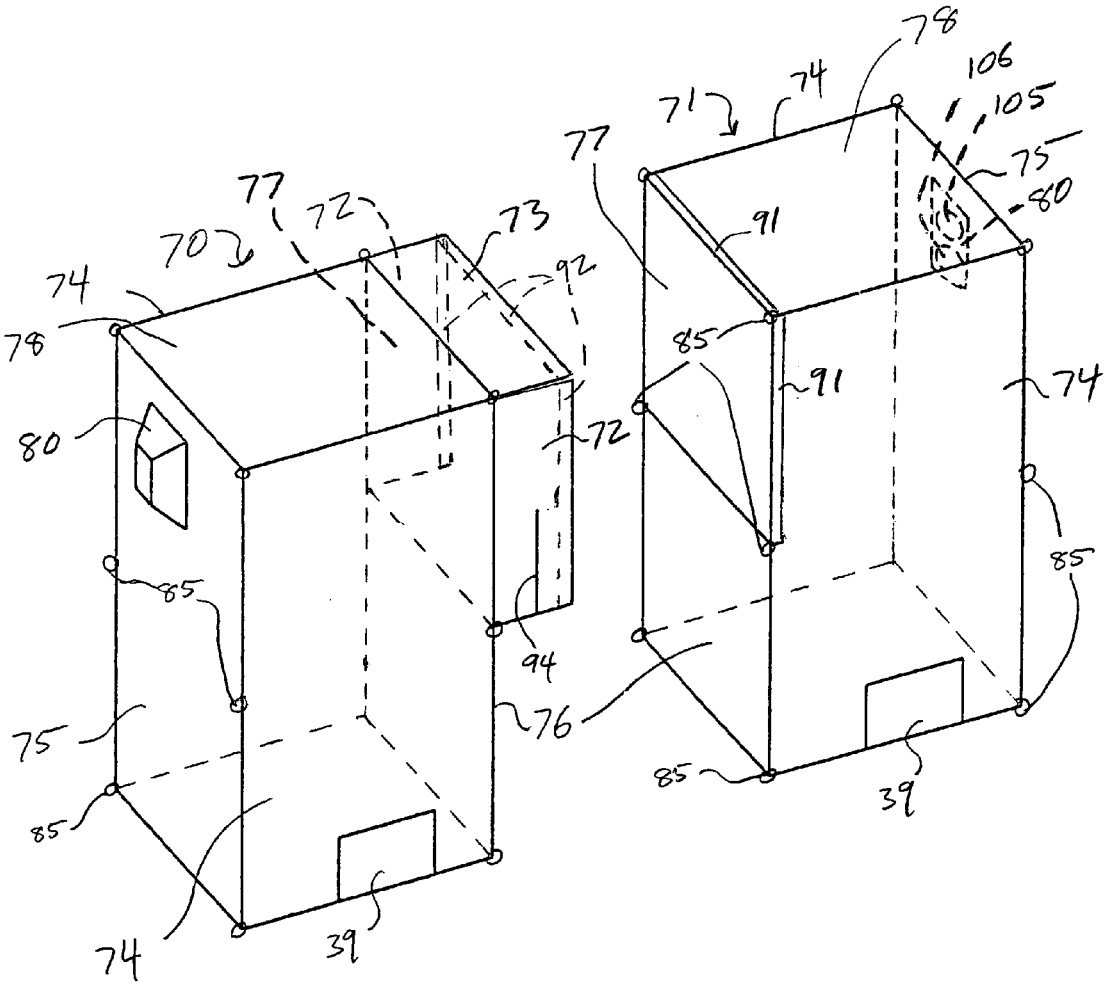
Figure 6:
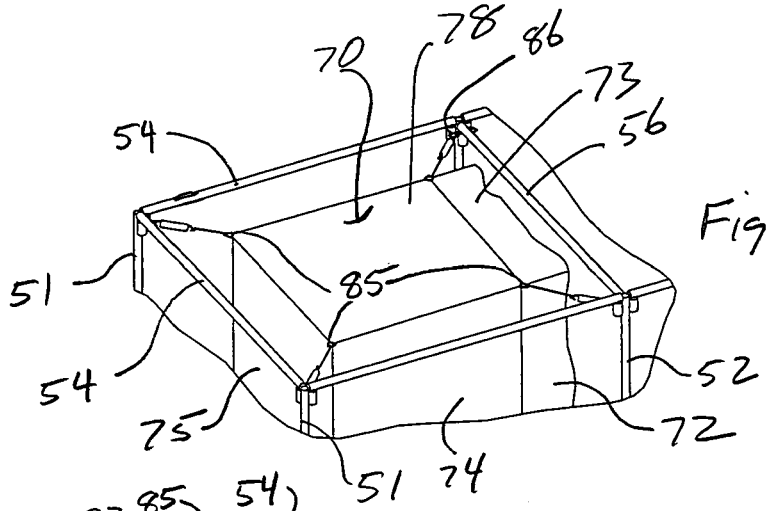
Figure 7:
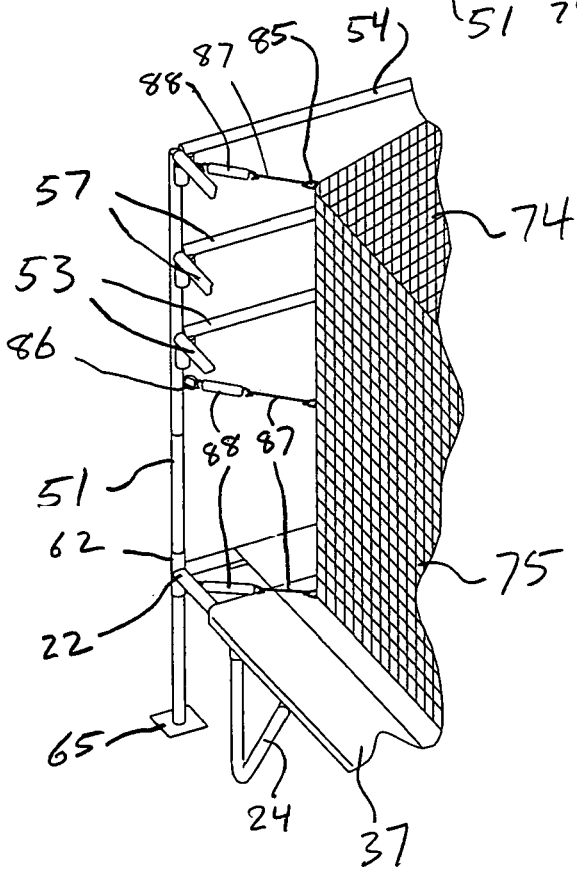
Figure 8:
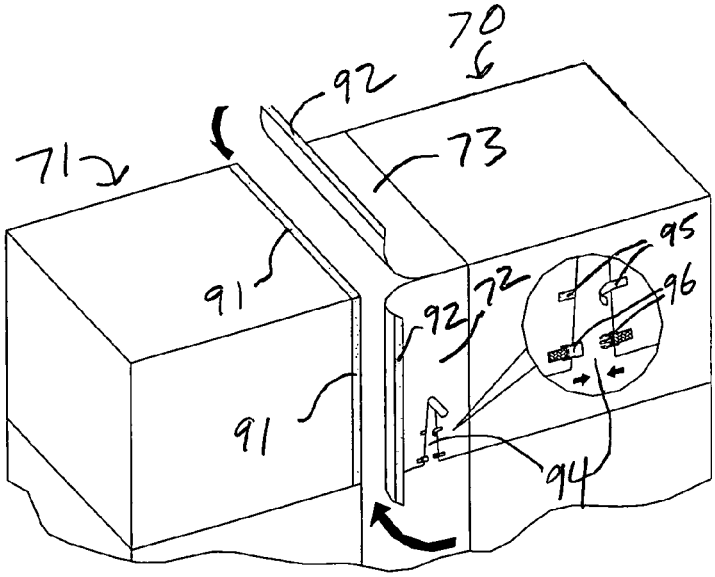
Figure 9:
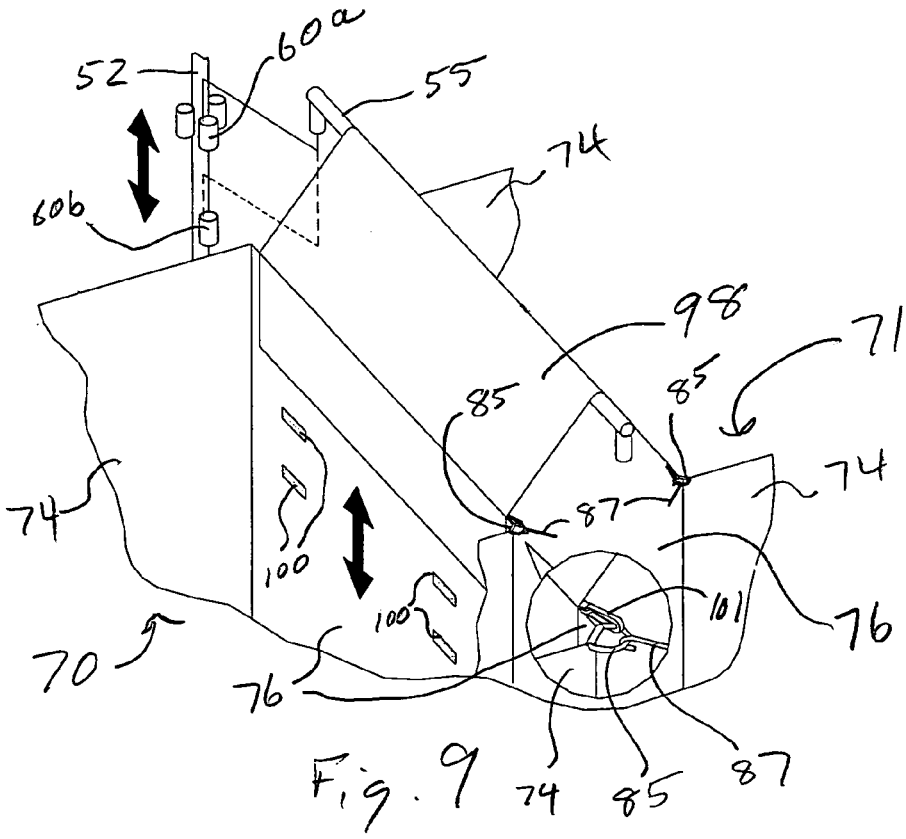
Figure 10:
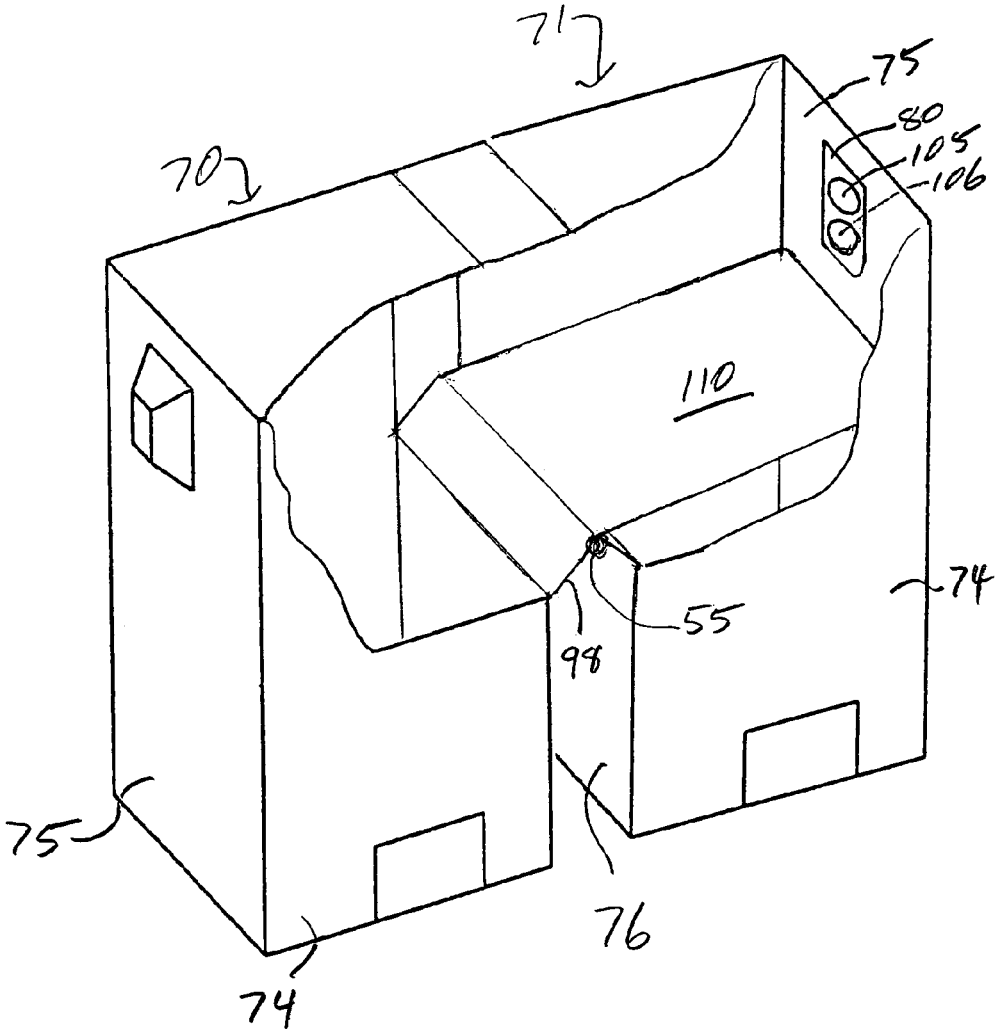
Figure 11:
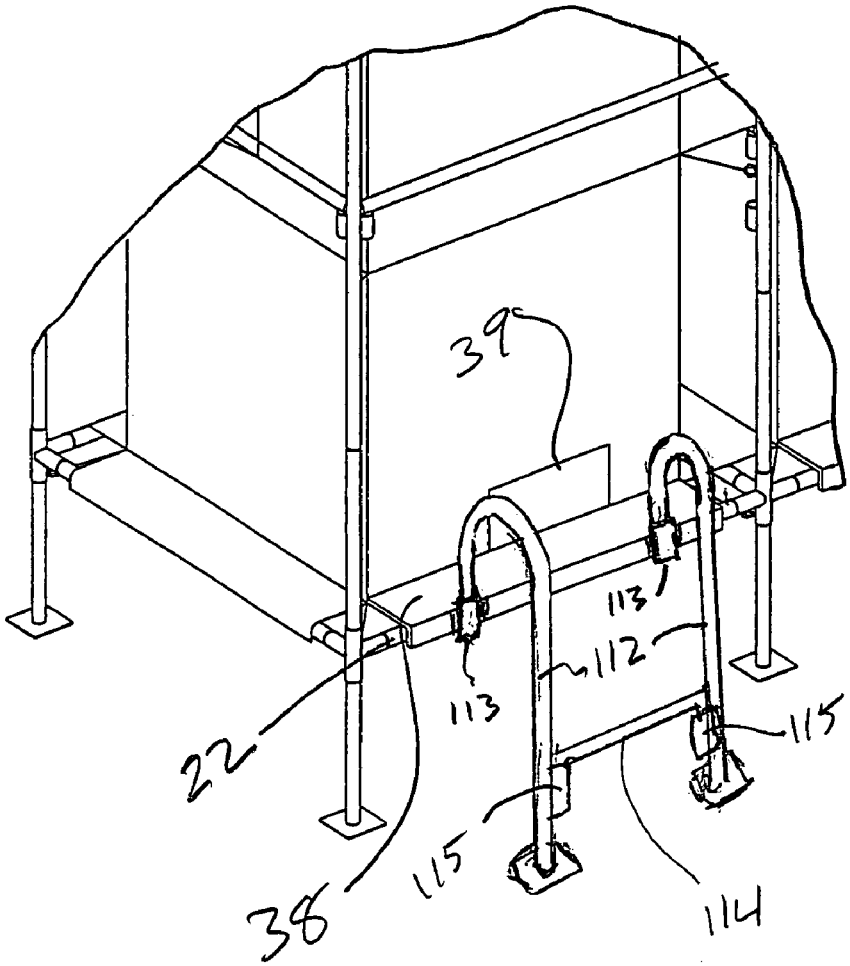
Figure 12:
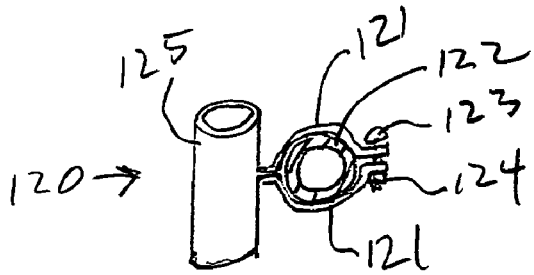
Figure 13:
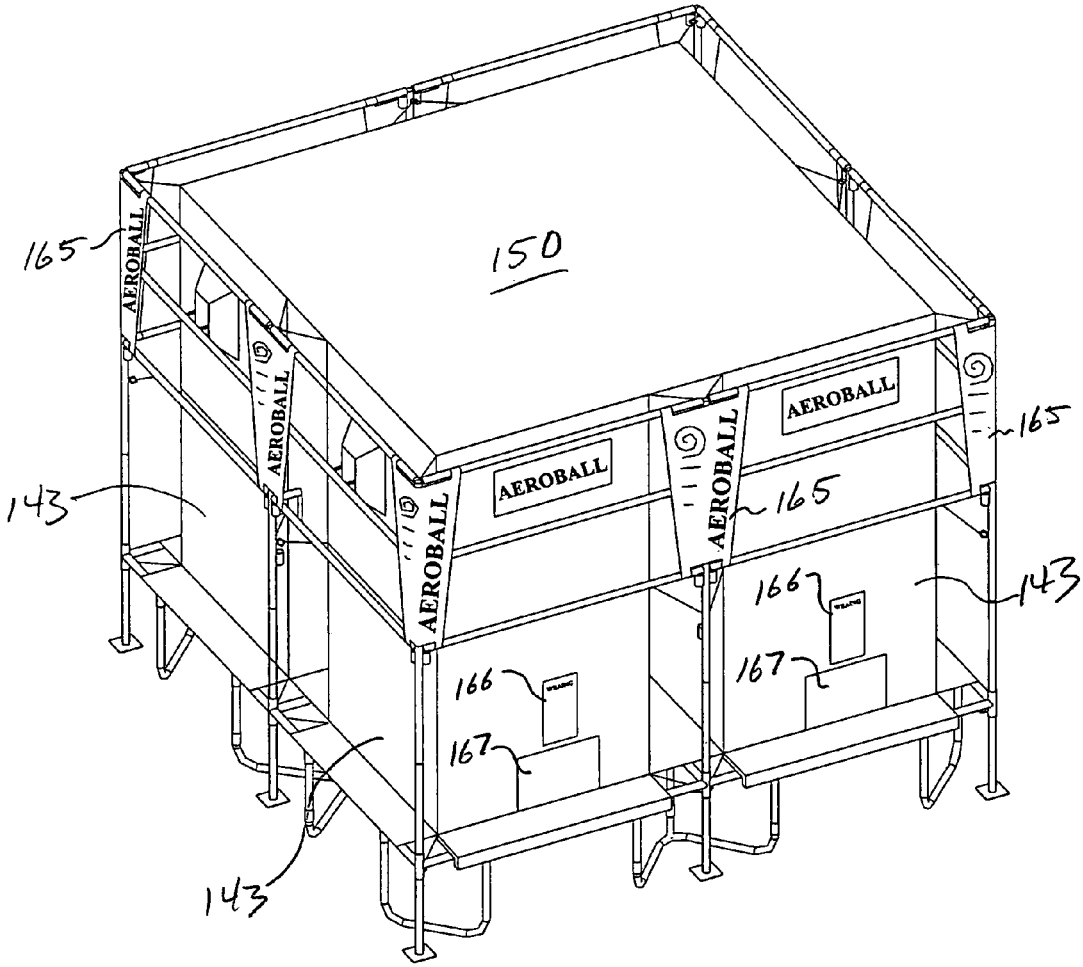
Figure 14:
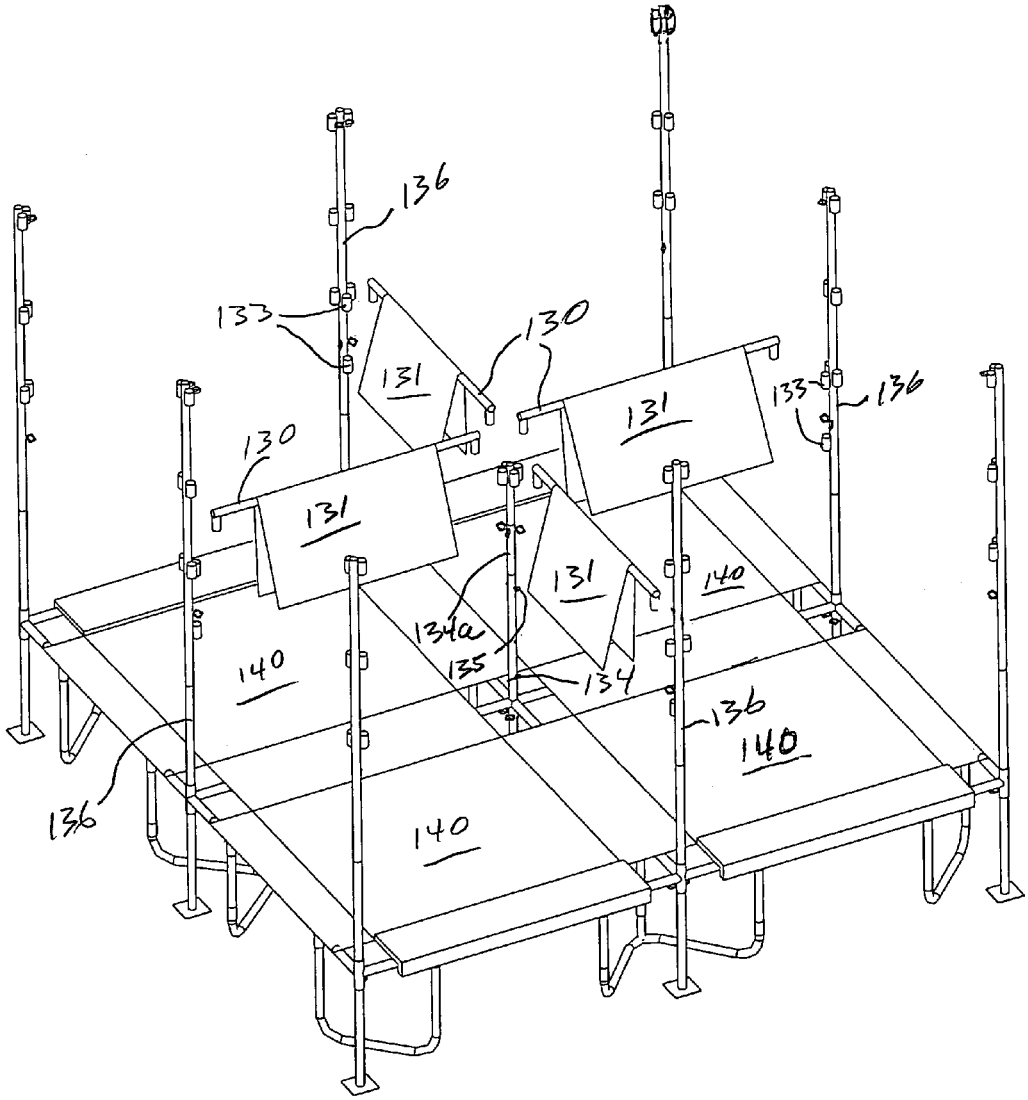
Figures 15, 15A, 15B:
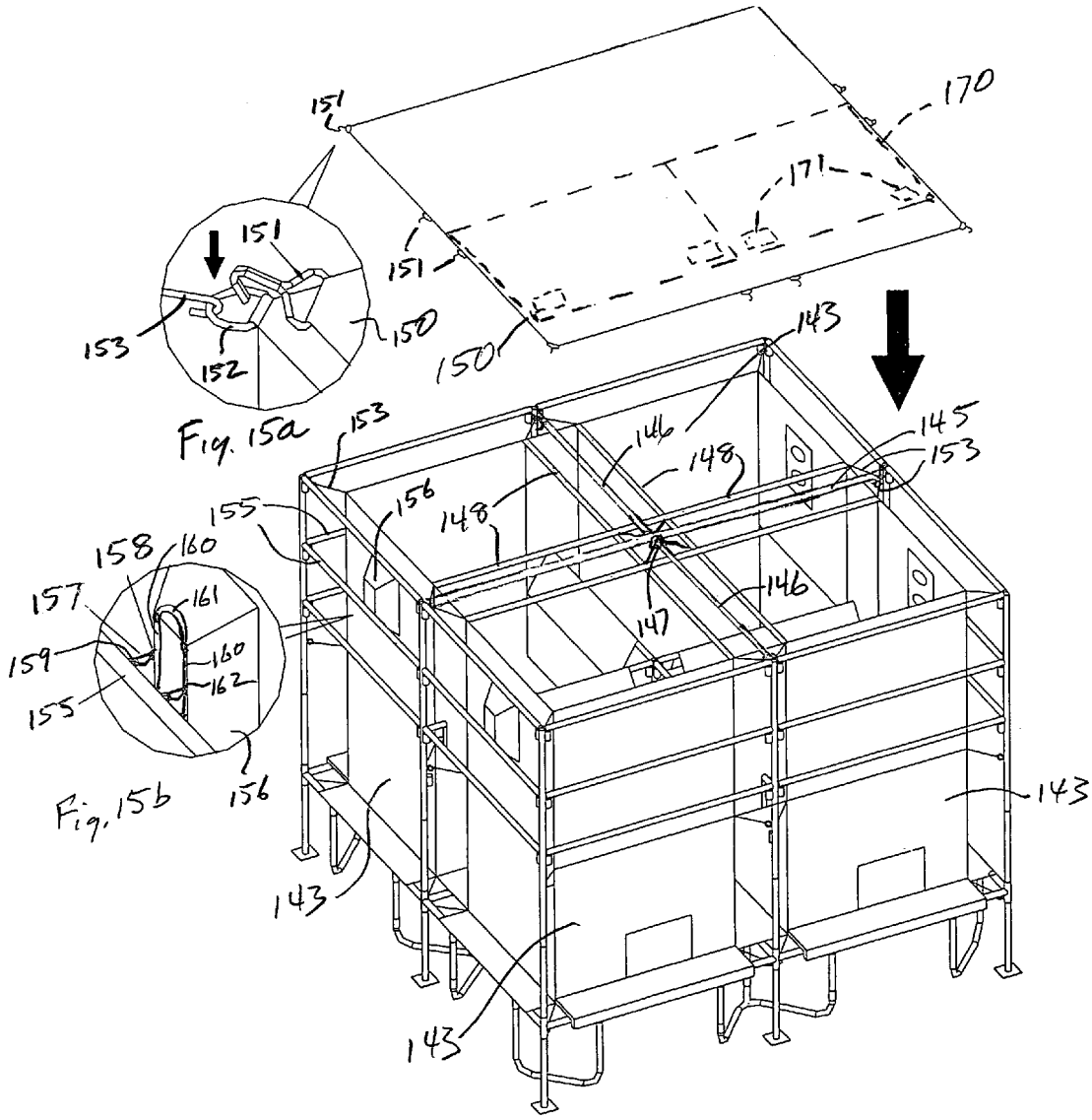
Figure 16:
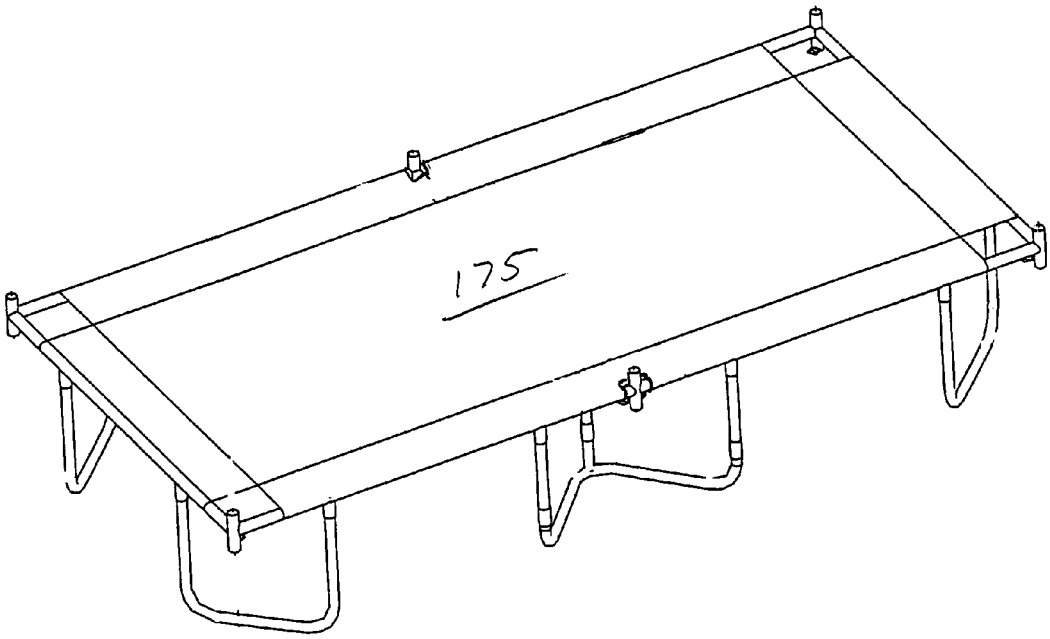

In the accompanying drawings, which show the best mode currently contemplated for carrying out the invention:

FIG. 1 is a perspective view of an assembled two player game apparatus according to the invention;

FIG. 2, an assembly view of the rebound surface mounting frame of the apparatus of FIG. 1;

FIG. 3, a fragmentary perspective assembly view of the rebound surface mounting frame of the apparatus of FIG. 1;

FIG. 3*a*, an enlarged detail view of the indicated portion of FIG. 3;

FIG. 3*b*, an enlarged detail view of the indicated portion of FIG. 3;

FIG. 4, a perspective view of the rebound surface mounting frame of the apparatus of FIG. 1 showing the flexible material mounting frame in assembly view in conjunction therewith;

FIG. 4*a*, an enlarged detail view of the indicated portion of FIG. 4;

FIG. 4*b*, an enlarged detail view of the indicated portion of FIG. 4;

FIG. 5, a perspective view of the flexible material assemblies for forming the individual play areas of the apparatus of the invention;

FIG. 6, a fragmentary perspective view of the top portion of the assembled apparatus of FIG. 1;

FIG. 7, a fragmentary perspective view of a corner portion of the assembled apparatus of FIG. 1;

FIG. 8, a fragmentary perspective view showing the connection of two flexible material assemblies for forming the individual play areas of the apparatus of the invention;

FIG. 9, a fragmentary perspective view showing a portion of the connection of the two flexible material assemblies for forming the individual play areas of the apparatus of the invention;

FIG. 10, a view similar to that of FIG. 5 showing a modification of the apparatus of the invention;

FIG. 11, a fragmentary perspective view of a corner portion of the apparatus of FIG. 1 with additional griping bars;

FIG. 12, a side elevation of a removable clamp for attaching a pole of a flexible material mounting frame to a trampoline frame showing a trampoline frame member in section;

FIG. 13, a perspective view of an assembled four player game apparatus according to the invention;

FIG. 14, a perspective view of the rebound surface mounting frame of the apparatus of FIG. 1 showing portions of the flexible material mounting frame in assembly view in conjunction therewith;

FIG. 15, a perspective view of an assembled four player game apparatus similar to that of FIG. 13 but with the top removed;

FIG. 15*a*, an enlarged detail view showing attachment of the indicated corner of the top to the remainder of the apparatus;

FIG. 15*b*, an enlarged detail view showing attachment of the basket assembly; and FIG. 16, a perspective view of the rebound surface mounting frame and rebound surface of a two player apparatus similar to that of FIG. 4, but showing a single rebound surface for the apparatus rather than two separate side by side rebound surfaces.

DETAILED DESCRIPTION OF THE ILLUSTRATED EMBODIMENTS

Although the game apparatus of the invention can be made with varying numbers of individual playing areas, the apparatus will generally be provided in two player models with two individual playing areas or in four player models with four individual playing areas. FIGS. 1-11 show a two player model and FIGS. 13-15 show a four player model. Further, with each model, a single large rebound surface can be provided so that different portions of the same rebound surface are divided into and included in the individual playing areas, or individual rebound surfaces can be provided for each individual playing area. The drawings show individual rebound surfaces for each playing area.

Referring to FIGS. 1-10 a two player game apparatus includes a rectangular rebound surface mounting frame, generally 20 as best seen in FIG. 2, having side members 21 connected by corner connectors 22 and intermediate connectors 23. Corner legs 24 connect to side members 21 through connector sleeves 25, and intermediate leg bottom sections 26 with straight leg sections 27 connect to side members 21 and intermediate cross member 28 also through connector sleeves 25. Corrugated rods 29 are secured, such as by welding to the sides of side members 21 and intermediate cross member 28 for attachment of springs 35, FIG. 3, to secure rebound surface 36 to rebound surface frame 20. FIG. 3 shows only the left hand portion of rebound surface mounting frame 20 as shown in FIG. 2 which mounts one rebound surface 36. A second rebound surface substantially identical to rebound surface 36 is also mounted on the right hand portion of rebound surface mounting frame 20 as shown in FIG. 4. Rebound surface mounting frame 20 with spring mounted rebound surface 36 form what is commonly referred to as a trampoline. Rebound surface mounting frame 20 as shown in FIGS. 1-4 form side by side rebound or trampoline surfaces 36. Spring covers 37 are secured over springs 36 for safety and aesthetic purposes and pad 38 is secured over springs 36 on the side of the frame that will include the door 39, FIG. 1, to the play areas to pad the springs as a player crawls or climbs over them to enter the play areas. Spring covers 37 may be secured over springs 36 by straps 40, FIG. 3*a*, on the underside of the covers, and pads 38 may be secured using ties 41, FIG. 3*b*. In addition, it is preferred that a strip of hook and loop fastener material such as VELCRO be secured to the edges of the rebound surface 36 as at 42 to mate with mating strips of hook and loop fastener material secured to the bottom edges of the spring covers 37 and pad 38 as at edges 43. The mating hook and loop fastening material holds the covers 37 and pads 38 more securely in place than merely straps 40 and ties 41 and slow the wear of such covers 37 and pads 38, but are not necessary as the straps and ties will hold the covers and pads in place.

A flexible material mounting frame, generally 50 as best seen in FIG. 4, includes vertical corner poles 51 and vertical intermediate poles 52, with horizontal mid side bars 53, horizontal top side bars 54, an intermediate cross frame member 55 and a top cross frame member 56. Walk bars 57 are also preferably provided on which a person assembling the flexible material mounting frame and securing the flexible material thereto can stand and walk to reach the top of the flexible material mounting frame to attach the flexible material to the top of the flexible material mounting frame. Since the vertical corner poles 51 and vertical intermediate poles 52 are relatively long, generally about fifteen feet or more, each of the vertical corner poles 51 and vertical intermediate poles 52 are preferably made up two separable telescoping sections 51*a* and 51*b* and 52*a* and 52*b*, respectively which are separated for shipping or other transportation and storage. Each of the side bars 53 and 54, the walk bars 57, the intermediate cross frame member 55, and the top cross frame member 56 are formed of tubes with ends 53*a*, 54*a*, 57*a*, 55*a*, and 56*a*, respectively, bent at ninety degrees to the length of the tube to slip into and be held by receiving sleeves 60 secured to corner poles 51 and intermediate poles 52. Rather than the ends being bent at ninety degrees, the tube ends could be secured, such as by welding, to the tubes at ninety degrees. This provides for easy assembly of the flexible material mounting frame 50 as the ends of the side bars 53 and 54, the walk bars 57, the intermediate cross frame member 55, and the top cross frame member 56 are easily inserted into respective receiving sleeves 60 to assemble the flexible material mounting frame 50.

The flexible material mounting frame 50 is interconnected with the rebound surface mounting frame 20 so that the two frames remain in substantially fixed relationship. However, the preferred mounting allows movement of the two frames in relation to one another to relieve stress in the frame that might otherwise develop if the frames were one rigid frame. To accomplish this, the frames are coupled by sliding vertical corner poles 51 of the flexible material mounting frame 50 through sleeves 62 which are part of the corner connectors 22 of the rebound surface mounting frame 20 and by sliding vertical intermediate poles 52 through sleeves 63 which are part of the intermediate connectors 23 of the rebound surface mounting frame 20. The poles 51 and 52 are slidingly received in the receiving sleeves 62 and 63 and are free to slide therein to equalize stress cause by uneven ground or other causes. Poles 51 and 52 rest directly on the surface supporting the game apparatus and have feet 65 secured to the bottom thereof to avoid scratching of floors or other hard surfaces on which the apparatus may be mounted or to prevent such poles from sinking into the ground or other soft surfaces the apparatus may be mounted on.

The flexible material to form the individual play areas is conveniently provided as separate assembled units for each play area. FIG. 5 shows schematically two of these assembled units 70 and 71. The only difference between these units are the connecting side flaps 72 and top flap 73 extending from unit 70 for attachment to unit 71. While various flexible materials may be used, the presently preferred material is a mesh or netting material, such as a vinyl coated dacron or nylon mesh, having mesh openings big enough so the material is generally see through, but small enough so that fingers or teeth do not pass into the openings. This allows people outside the apparatus to watch the game being played in the apparatus, but maintains the safety of the apparatus. Both units 70 and 71 have opposite side walls 74, back walls 75, and partial front walls 76. These wall form the individual play areas within the walls. The upper portions of the front of each unit are open as at 77. These open areas form an opening between the units when the units are joined together to allow play objects, such as balls, to move between individual play areas. The top of each unit may be closed, as shown, by tops 78 or may be left open. If left open, a separate top will be positioned over the tops of the units by the flexible material mounting frame to close the tops to prevent play objects used in the apparatus from coming out of the play areas. The bottom of each unit is open so when positioned over a rebound surface 36 of the apparatus, the rebound surface forms the floor for each play area. Doors 39, generally formed by an opening in the wall and a flap over the opening, are provided in one of the side walls 74 in each unit. A goal or basket assembly 80 is provided in each of the back walls 75.

Various ties, hooks, and reinforcing webbing material strips, not shown in FIG. 5, are provided for securing the units in the flexible material mounting frame over the rebound surfaces. The units 70 and 71 are assembled by sewing or otherwise connecting the various pieces of the flexible material and other materials as needed to form the preassembled units 70 and 71.

The assembled apparatus is shown in FIG. 1. Once the rebound surface mounting frame is assembled, the rebound surface or surfaces mounted in the rebound surface mounting frame, and the flexible material mounting frame is assembled as coupled to the rebound surface mounting frame as shown in FIG. 4, the preassembled flexible material units are mounted to the flexible material mounting frame over the rebound surfaces to complete assembly of the apparatus. In securing the preassembled flexible material units to the flexible material mounting frame, the units are hung in the frame from the top and the bottom and preferably an intermediate portion of the sides are also secured to the mounting frame to securely hold the flexible material units in position in the mounting frame. Thus, rings 85, such as "D" rings, are secured to the top corners of each unit 70 and 71, to the bottom corners of each unit, and to intermediate edges, as shown in FIGS. 5, 6, 7, and 1. These rings are then resiliently attached to similar rings 86 secured to poles 51 and 52 of the flexible material support frame through links 87 and springs 88 as shown in FIGS. 6 and 7, and schematically as attachments 89 in FIG. 1. A strip of reinforcing webbing material 90, FIG. 1, may connect the intermediate edge rings 85. Such reinforcing webbing material will also generally extend along the top edges and bottom edges of the units connecting the top and bottom rings 85.

Units 70 and 71 will be spaced apart as shown in FIG. 1 when assembled in the apparatus to prevent a player who may fall against the front wall of a play area from hitting a player in the other play area. This is a further safety feature of the invention. Because of this separation, the area around the opening 77 between the two units should be closed to prevent a play object, such as a ball, from leaving the adjoined play areas. For this purpose, when the units 70 and 71 are assembled as shown in FIG. 1, side flaps 72 of unit 70 extend to unit 71 and close the side area between the units, and top flap 73 of unit 70 extends to unit 71 and closes the top area between the units. Preferably some type of connectors connect the ends of the flaps to unit 71. For this purpose, it has been found convenient to secure a strip of hook and loop fastener 91, FIGS. 5 and 8, to the side and top edges of unit 71 around opening 77 and secure a mating strip of hook and loop fastener 92 along the edges of flaps 72 and 73 of unit 70. When assembled as shown in FIG. 1, the flaps are extended between the units and secured to close the side and top spaces between the units. Intermediate cross frame member 55 extends across the frame between units 70 and 71 and defines the lower edge of the opening 77 between the units. It is preferred that the intermediate cross frame member be height adjustable to adjust the bottom level of the opening 77 between the units 70 and 71 between two heights. Additional adjustment can be provided, but adjustment between two heights has been found sufficient. Intermediate cross frame member 55 extends between opposite sleeves 60 secured to intermediate poles 52, FIG. 4. To provide the height adjustment, two sleeves 60, indicated as sleeves 60*a* and 60*b* in FIG. 9 which shows one pole 52, are provided on each pole 52 at different desired heights. The ends of intermediate cross frame member 55 can be placed in the selected pairs of opposing sleeves 60 to mount intermediate cross frame member 55 at the desired height along poles 52. FIG. 1 shows intermediate cross frame member 55 mounted in the upper of the two pairs of opposing sleeves, i.e., in the upper position. In this position, intermediate cross frame member 55 extends through a closeable slit 94, FIGS. 1, 5, and 8, in side flaps 72, and the slit 94 is closed by mating hook and loop material tabs 95, FIG. 8, and particularly the enlarged insert of FIG. 8, and/or clips 96. When intermediate cross frame member 55 is moved to its lower position, it will be at the bottom end of slit 94 and again the slit will be secured closed to prevent a play item from leaving the play area.

To close the bottom of opening 77 between units 70 and 71, flexible material 98, FIGS. 4 and 8, is draped over intermediate cross frame member 55 with the flexible material 98 extending from intermediate cross frame member 55 on both sides downwardly and outwardly to front walls 76, FIGS. 9 and 5, of units 70 and 71. Strips of hook and loop material 100, FIG. 9, may be secured to the inside of front walls 76 to mate with mating strips of hook and loop material, not shown, on the underside of material 98 to secure the edges of material 98 to the front walls 76 of units 70 and 71. Several strips 100 of hook and loop material are spaced along the height of the front walls 76 so material 98 can be secured to front walls 76 in either of the height positions of intermediate cross frame member 55. If desired, clips 101 can be provided along the outside edges of material 98 to be clipped to "D" ring 85 and secured to the flexible material mounting frame along with "D" ring 85 as shown in FIG. 9 and the enlarged insert of FIG. 9. These clips 101 ensure that material 98 stretches from side to side of front walls 76. Intermediate cross frame member 55 is padded to prevent injury to a player who may hit the cross member. This padding may be padding wrapped around member 55 independently of material 98, or may be padding attached to the underside of material 98 where it drapes over member 55. The provision of intermediate cross frame member 55 not only defines the lower edge of opening 77 between playing areas and provides support for material 98, but also strengthens the flexible material mounting frame 50 and prevents bowing of posts 52. Without such cross member, posts 52 have to be extremely heavy to minimize bowing when the material defining and separating play areas is attached thereto.

Goal or basket assemblies 80, FIGS. 1 and 5, are secured in the back wall 74 of each unit 70 and 71. The basket assemblies provide the goals at which players in playing areas direct playing objects such as balls during play of many of the various games that can be played in the apparatus. Thus, in some games, a player in one play area attempts to throw a ball through the adjoining play area past the player in that adjoining play area and into the basket or goal. The basket will generally have an inlet 105 and outlet 106 so that when the ball is thrown into the inlet, it will be directed by the basket assembly to the outlet so that it exits the basket assembly through the outlet and a player does not have to reach into the basket to remove it. The basket assembly is generally secured, such as by sewing, in the back wall material. In addition, it is mounted to the flexible material mounting frame as shown in FIG. 1. In the past, the mounting to the frame has been with springs. However, with movement of the material, a problem has been that the springs become momentarily decompressed and separate from the frame. It is currently preferred that the basket assembly be secured to the frame with closed links, such as snap rings 107, FIG. 1, so that the basket assembly remains secured to the frame. The snap rings attach to attachment rings 108, FIG. 4*b*, secured, such as by welding, to walk bar 57.

In some instances, a single player may want to play or practice throwing a ball at a basket without a player present in the adjoining play area. In such instance, the player does not want to lose the ball in the vacant play area, but would like it to return to the play area from which it is thrown. In order to have the ball return, a temporary sloped platform 110, FIG. 10, may be attached between the back wall 74 in the vacant play area and over material 98 so that a ball thrown into the vacant play area, whether or not it makes the basket or goal, rolls down the sloped material 110 to return to the play area from which it was thrown. Generally, the sloped material 110 can be the same flexible material making up the walls of the play areas and can be secured in place with clips or ties provided on the sloped material and the walls of the play areas.

As indicated, for entering or leaving the play areas, a door 39, generally a flap over a small entrance opening, is provided. Pad 38 allows a player to easily crawl over springs 35 without discomfort. To aid in mounting or dismounting the rebound surface, bars 112 are mounted in sleeves 113 secured to side rebound surface mounting frame side bar 22 on opposite sides of door 39. A rail 114 placed in sleeves 115 tend to keep the bars 112 from rotating and provides a step. Feet 116 are provided on the bottom of bars 112.

While it is preferred to build the rebound surface mounting frame and the flexible material mounting frame specifically to match, a game apparatus of the invention can be built from a standard trampoline with a flexible material mounting frame coupled to the existing trampoline frame. For such purpose, mounting sleeves for receiving and holding the poles of the flexible material mounting frame may be removably secured to the trampoline frame. For example, FIG. 12 shows a clamp 120 for removable attachment to a trampoline frame member. Clamp arms 121 are placed around trampoline frame member 122 and a screw 123 is tightened into nut 124 to tightly close the clamp around trampoline member 122. Clamp 120 provides a sleeve 125 for receiving a pole of the flexible material mounting frame.

FIGS. 13-15 show a four player version of the apparatus of the invention. FIG. 13 shows an assembled four player version and is similar to FIG. 1 for the two player version. FIG. 14 is similar to FIG. 4 for the two player version but does not show the side bars or top cross bars. However, it does show the intermediate cross members 130 with flexible material sheets 131 which are draped over the cross members 130. These intermediate cross members 130 fit into receiving sleeves 133 and are height adjustable between two height positions as explained for the two player version. However, a center pole 134 is provided which has telescoping portions to provide the height adjustment for that center pole. Upper pole portion 134*a* slides in lower pole portion 134 and is held in desired height position by pin 135 which passes through aligned holes in both pole portions when at the desired set height. This adjustment of the pole adjusts the height of sleeves 135 which receive the inner ends of cross members 130. These heights correspond to the two selectable sleeves 133 on the intermediate poles 136. FIG. 14 also shows the arrangement of four rebound surfaces 140 arranged in rebound surface mounting frame 141. With the four player apparatus, four individual play areas are divided and positioned above the four rebound surfaces 140. The play areas are formed by preassembled flexible material units 142 shown in FIGS. 13 and 15. These are similar to the preassembled units shown and described for the two player apparatus. The difference is that the units are open on two sides rather than one side so that all four play areas are connected by upper openings. This is shown in FIG. 15 where the upper portion of the inside of the play areas are open to one another. The flexible material units 143 defining the four individual play areas are secured to the flexible material mounting frame at the corners of the units as shown and described for the two player units, except for the center of the apparatus where four corners come together. Here, the corners are resiliently connected to top cross member 145 at its junction with top cross members 146 connected through sleeves 147 to top cross member 146. Since the flexible material units 143 are open at their top portions and the walls do not extend to the top where the four units come together, strips of web material 148 define the edges and corners of the play areas at the top and the corners where the strips of web material come together are preferably resiliently secured to top cross member 145. Top cross member 145 may be a double member or larger member to support the other cross members 146 and webbing material 148. Also, since top cross member 145 is about fifteen feet long, it may be made in two pieces which telescope together so it can be separated into two pieces for shipping and storage. Units 143 may have individual tops, or as shown, may have open tops. When they have open tops, a separate top piece 150 is provided to cover the tops of all individual play areas. Top 150 may be secured directly to the flexible material mounting frame or, as shown, may be secured to the top of the flexible material units 143 as by hooks 151, FIG. 15*a*, attached to "D" rings 152 which are secured to the flexible material mounting frame by resilient connectors 153 as described for the two player apparatus.

Similarly to the two player apparatus, the four player apparatus includes walk bars 155 and basket assemblies 156 which are secured to the mounting frame through snap rings 157, FIG. 15*b*, connected between basket assembly rings 158 and rings 159 extending from walk bars 155. FIG. 15*b* shows the basket assembly 156 with sleeves 160 which receives a mounting bar 161 therein. Mounting bar 161 provides the rings 158 extending therefrom and through openings 162 in sleeves 160. Sleeves 160 are preferably closed at their bottom ends and open only at their top ends to receive mounting bar 161. Mounting bar 161 maintains the configuration of the basket assembly 156.

FIG. 13 shows advertising banners 165 attached to the flexible material mounting frame to advertise the apparatus and safety warning signs 166 secured to the outside of the walls of the flexible material units 143 above doors 167 where they can be seen and read by players before entering the play areas of the apparatus.

If desired, flaps 170, FIG. 15, may be provided on the underside of top 150 to be normally held against the underside of top 150 by fasteners such as patches of mating hook and loop material 171 when the apparatus is used for four players, or can be extended from the underside of top 150 to close the opening between two of the play areas and divide the four player apparatus into two side by side two player configurations. This provides flexibility to the four player apparatus.

FIG. 16 shows a rebound surface mounting frame and rebound surface for a two player apparatus similar to that previously described, but showing a single rebound surface 175 for the apparatus rather than two separate side by side rebound surfaces as previously shown. The same flexible material mounting frame and flexible material units secured in the mounting frame are used as previously shown and described. However, with the single rebound surface, different portions of the same rebound surface is used for the floor of both play areas rather than having separate rebound surfaces for each play area. This adds different rebound surface characteristics than separate rebound surfaces and requires different game playing skills. The single rebound surface can also be used with the four player apparatus. Further, various configurations such as round or octagon shaped rebound surfaces can be used with individual play areas configured to correspond to the shape of the rebound surface.

While the apparatus can be provided in various sizes, a size which has been found satisfactory provides individual play areas of about four feet nine inched by four feet nine inches. For this size play areas, a rebound surface beneath the play areas of about five feet by five feet is desirable. This then requires that the rebound surface mounting frame be about fifteen feet long to provide two five feet by five feet side by side rebound surfaces. A two player apparatus will then be about fifteen feet by seven and one half feet and a four player apparatus will be about fifteen feet by fifteen feet. The units will preferably be about fifteen feet high.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

I claim:

1. A game apparatus comprising:

at least one rebound surface upon which a player can jump;

flexible material extending substantially vertically up from the at least one rebound surface dividing the at least one rebound surface into at least two individual play areas having the at least one rebound surface as a floor;

an opening between the play areas to allow a play object to move between play areas, said opening being a preset distance above the rebound surface;

a rebound surface mounting frame supporting the at least one rebound surface;

a flexible material mounting frame supporting the flexible material;

coupling members interconnecting the frames in substantially fixed relationship;

at least one cross frame member extending between the play areas to support the flexible material between the play areas and reinforce the frame; and wherein the flexible material extends over the at least one cross frame member and extends downwardly and outwardly on each side of the at least one cross frame member before extending substantially vertically to the at least one rebound surface.

2. The game apparatus according to claim 1, wherein the coupling members include sleeves secured to one frame through which frame members of the other frame are slidably received.

3. The game apparatus according to claim 2, wherein the coupling members including the sleeves are removably secured to the one frame.

4. The game apparatus according to claim 3, wherein the coupling members are removably secured to the rebound surface mounting frame.

5. The game apparatus according to claim 1, wherein the flexible material mounting frame supporting the flexible material additionally includes a walk bar extending peripherally around the flexible material mounting frame at a height wherein a person assembling the flexible material mounting frame can stand on the walk bar and reach the top of the flexible material mounting frame to attach the flexible material to the top of the flexible material mounting frame.

6. The game apparatus according to claim 1, wherein the at least one cross frame member is padded.

7. The game apparatus according to claim 1, wherein the opening between play areas extends upwardly from the cross frame member.

8. The game apparatus according to claim 7, wherein the cross frame member is height adjustable.

9. The game apparatus according to claim 8, wherein the cross frame member is height adjustable between two heights.

10. A game apparatus comprising:

at least one rebound surface upon which a player can jump;

flexible material extending substantially vertically up from the at least one rebound surface dividing the at least one rebound surface into at least two individual play areas having the at least one rebound surface as a floor, each play area having a periphery and the flexible material substantially entirely surrounding the periphery of the individual play areas;

an opening between the play areas to allow a play object to move between play areas, said opening being a preset distance above the rebound surface;

a rebound surface mounting frame supporting the at least one rebound surface;

a flexible material mounting frame supporting the flexible material;

coupling members interconnecting the rebound surface mounting frame and the flexible material mounting frame in substantially fixed relationship while allowing movement of one frame in relation to the other frame to relieve stress between frames;

at least one cross frame member extending between the play areas to support the flexible material between the play areas and reinforce the frame;

wherein the opening between play areas extends upwardly from the cross frame member; and a basket in each play area adapted to receive a play object therein properly directed thereto, said basket comprising a basket frame, basket material secured to the basket frame to form the basket, and attachment links attaching the basket to the flexible material mounting frame.

11. The game apparatus according to claim 10, wherein the attachment links are snap rings.

12. A game apparatus comprising:

at least one rebound surface upon which a player can jump;

flexible material extending substantially vertically up from the at least one rebound surface dividing the at least one rebound surface into at least two individual play areas having the at least one rebound surface as a floor;

an opening between the play areas to allow a play object to move between play areas, said opening being a preset distance above the rebound surface;

a rebound surface mounting frame supporting the at least one rebound surface;

a flexible material mounting frame supporting the flexible material;

coupling members interconnecting the frames in substantially fixed relationship while allowing movement of one frame in relation to the other frame to relieve stress between frames;

a basket in each play area adapted to receive a play object therein properly directed thereto, said basket comprising a basket frame, basket material secured to the basket frame to form the basket, and attachment links attaching the basket to the flexible material mounting frame to position a basket in the flexible material forming each play area opposite the opening between play areas to allow a player in one play area to direct a play object through the opening to the basket in an adjacent play area, wherein the basket includes an inlet and an outlet so that a play object entering the inlet will exit the outlet, and return material extending between the basket and the opening to direct the play object directed toward the basket in one play area back into the adjacent play area from which it came to enable a single player to play a game of directing a play object toward the basket in an adjacent play area.

13. The game apparatus according to claim 1, wherein the flexible material divides the at least one rebound surface into two individual play areas.

14. The game apparatus according to claim 13, wherein the at least one rebound surface is two rebound surfaces, one rebound surface for each of the two individual play areas.

15. The game apparatus according to claim 1, wherein the flexible material divides the at least one rebound surface into four individual play areas.

16. The game apparatus according to claim 15, wherein the at least one rebound surface is four rebound surfaces, one rebound surface for each of the four individual play areas.

17. The game apparatus according to claim 15, wherein the flexible material includes a flap positionable to close the openings between two of the four play areas to form two sets of two play areas.

18. A game apparatus comprising:

at least one rebound surface upon which a player can jump;

flexible material extending substantially vertically up from the at least one rebound surface dividing the at least one rebound surface into at least two individual play areas having the at least one rebound surface as a floor;

an opening between the play areas to allow a play object to move between play areas, said opening being a preset distance above the rebound surface;

a rebound surface mounting frame supporting the at least one rebound surface;

a flexible material mounting frame supporting the flexible material;

coupling members interconnecting the frames in substantially fixed relationship while allowing movement of one frame in relation to the other frame to relieve stress between frames;

wherein each individual play area includes a flap through the flexible material forming the play area to the outside through which a player may enter the play area, and additionally including grip bars mounted on the rebound surface frame to be held by a player exiting the play area.

19. The game apparatus according to claim 18, wherein springs extend from the rebound surface mounting frame to the at least one rebound surface supported thereby, additionally including padding material over the springs adjacent the flap, and hook and loop fastening material securing the padding material over the springs adjacent the flap.

20. The game apparatus according to claim 19, additionally including cover material over the springs not covered by the padding material, and hook and loop fastening material securing the cover material over the springs not covered by the padding material.

21. A game apparatus comprising:

at least one rebound surface upon which a player can jump;

flexible material extending substantially vertically up from the at least one rebound surface dividing the at least one rebound surface into at least two individual play areas having the at least one rebound surface as a floor and each having a periphery, each individual play area being formed by an individual preassembled flexible material unit configured so that the flexible material of the individual preassembled flexible material unit substantially entirely surrounds the periphery of an individual play area and is spaced from other preassembled flexible material units to thereby space individual play areas;

an opening between the play areas to allow a play object to move between play areas, said opening being a preset distance above the rebound surface; and a mounting frame supporting the at least one rebound surface and at least two of the flexible material units to form the individual play areas;

at least one cross frame member extending between the individual play areas to support the flexible material between the play areas and reinforce the frame, wherein the opening between play areas extends upwardly from the cross frame member; and wherein the flexible material extends over the at least one cross frame member and extends downwardly and outwardly on each side of the at least one cross frame member before extending substantially vertically to the at least one rebound surface.

22. A game apparatus comprising:

at least one rebound surface upon which a player can jump;

flexible material extending substantially vertically up from the at least one rebound surface dividing the at least one rebound surface into at least two individual play areas having the at least one rebound surface as a floor, each play area having a periphery and the flexible material substantially entirely surrounding the periphery of the individual play areas;

an opening between the play areas to allow a play object to move between play areas, said opening being a preset distance above the rebound surface;

a rebound surface mounting frame supporting the at least one rebound surface;

a flexible material mounting frame supporting the flexible material;

coupling members interconnecting the rebound surface mounting frame and the flexible material mounting frame in substantially fixed relationship while allowing movement of one frame in relation to the other frame to relieve stress between frames;

at least one cross frame member extending between the play areas to support the flexible material between the play areas and reinforce the frame;

wherein the opening between play areas extends upwardly from the cross frame member; and wherein the flexible material extends over the at least one cross frame member and extends downwardly and outwardly on each side of the at least one cross frame member before extending substantially vertically to the at least one rebound surface.

23. The game apparatus according to claim 22, wherein the cross frame member is height adjustable.

24. The game apparatus according to claim 21, wherein the flexible material mounting frame supporting the flexible material additionally includes a walk bar extending peripherally around the flexible material mounting frame at a height wherein a person assembling the flexible material mounting frame can stand on the walk bar and reach the top of the flexible material mounting frame to attach the flexible material to the top of the flexible material mounting frame.

25. The game apparatus according to claim 21, wherein the flexible material divides the at least one rebound surface into two individual play areas.

26. The game apparatus according to claim 21, wherein the flexible material divides the at least one rebound surface into four individual play areas.

27. The game apparatus according to claim 21, wherein each individual preassembled flexible material unit includes an opening through which a player may enter the play area.

28. The game apparatus according to claim 21, wherein the mounting frame includes a rebound surface mounting frame supporting the at least one rebound surface and a flexible material mounting frame supporting the at least two flexible material units to form the individual play areas.

* * * * *